US005684758A

United States Patent [19]

Gray et al.

[11] Patent Number: 5,684,758

[45] Date of Patent: Nov. 4, 1997

[54] CHILD DISCIPLINARY DEVICE

[75] Inventors: Jacqueline D. Gray, Grand Rapids; Margaret B. Sterr, Grosse Pointe Woods, both of Mich.

[73] Assignee: T.O.T. Ventures, Inc., East Grand Rapids, Mich.

[21] Appl. No.: 556,988

[22] PCT Filed: Jun. 28, 1995

[86] PCT No.: PCT/US95/08241

§ 371 Date: Nov. 20, 1995

§ 102(e) Date: Nov. 20, 1995

[87] PCT Pub. No.: WO96/01444

PCT Pub. Date: Jan. 18, 1996

Related U.S. Application Data

[63] Continuation of PCT/US95/08241, Jun. 28, 1995, which is a continuation of Ser. No. 271,080, Jul. 6, 1994, abandoned.

[51] Int. Cl.[6] ..... G04B 47/00; G04F 8/00; A63H 3/02

[52] U.S. Cl. ..... 368/10; 368/45; 368/97; 368/108; 446/369

[58] Field of Search ..... 368/10, 45, 97–99, 368/107–109, 276, 278; 434/304; 446/369–372

[56] References Cited

U.S. PATENT DOCUMENTS

| | | | |
|---|---|---|---|
| D. 176,020 | 11/1955 | Ising . | |
| D. 181,344 | 11/1957 | Delpidio . | |
| D. 247,481 | 3/1978 | Bernyk . | |
| D. 259,923 | 7/1981 | Chavana . | |
| D. 327,019 | 6/1992 | Hiraike . | |
| D. 336,856 | 6/1993 | Chen . | |
| 2,651,908 | 9/1953 | Fargo . | |
| 2,926,487 | 3/1960 | Stone . | |
| 4,006,586 | 2/1977 | Casella | 361/276 |
| 4,685,599 | 8/1987 | Israel et al. | 360/45 |
| 4,742,500 | 5/1988 | Luce | 360/10 |
| 4,769,799 | 9/1988 | Matsukage | 360/278 |
| 5,044,961 | 9/1991 | Bruskeliite | 368/223 |

*Primary Examiner*—Vit W. Miska
*Attorney, Agent, or Firm*—Warner Norcross & Judd

[57] ABSTRACT

A child's disciplinary device including a plush toy and a countdown timer secured to the toy. The timer includes indications corresponding to children's ages, and the timer is set to a proper time-out period by setting the timer to the child's age. The correspondence between ages and time-out periods is nonlinear.

14 Claims, 3 Drawing Sheets

| AGE | TIME-OUT LENGTH |
|---|---|
| 1 | 30 SECONDS |
| 2 | 45 SECONDS |
| 3 | 2 MINUTES |
| 4 | 3 MINUTES |
| 5 | 4 MINUTES |
| 6 | 5 MINUTES |
| 7 | 7 MINUTES |
| 8 | 8 MINUTES |
| 9 | 9 MINUTES |
| 10 | 10 MINUTES |

| AGE | TIME-OUT LENGTH |
|---|---|
| 1 | 30 SECONDS |
| 2 | 45 SECONDS |
| 3 | 2 MINUTES |
| 4 | 3 MINUTES |
| 5 | 4 MINUTES |
| 6 | 5 MINUTES |
| 7 | 7 MINUTES |
| 8 | 8 MINUTES |
| 9 | 9 MINUTES |
| 10 | 10 MINUTES |

CHILD DISCIPLINARY DEVICE

This application is a Section 371 of Application No. PCT/US95/08241 filed Jun. 28, 1995, which is a continuation-in-part of application Ser. No. 08/271,080 filed Jul. 6, 1994 (now abandoned).

TECHNICAL FIELD

The present invention relates to children's disciplinary devices, and more particularly to devices used in providing "time out" discipline.

BACKGROUND ART

The "time out" discipline method has gained widespread acceptance for disciplining children and disabled adults. According to this method, the individual to be disciplined is immediately removed from a situation of undesired activity, placed in a quiet distraction-free setting, and made to reflect on his or her actions for a time period determined by the child's age. A timer is used to, keep track of this time period. The idled offender often seizes upon the idleness to perform other undesired activities such as pouting or whining. If put into a chair, the offender often slouches, squirms, or removes cushions or seat covers, thus engaging in further undesired activity.

Typically, the timer is spatially separated from the offender, so that the child often is not aware of the time remaining. This further frustrates and/or confuses the offender.

DISCLOSURE OF INVENTION

The aforementioned problems are overcome in the present invention wherein a children's disciplinary device comprises a plush toy, for example a stuffed animal, and a countdown timer secured to the toy. Preferably, the countdown timer includes a face generally co-planar with the surface of the toy.

Preferably, the timer includes indications corresponding to children's ages; and the time-out period provided by the countdown timer is a non-linear function of the child's age. Young children receive less than one minute per year of age; and older children receive approximately one minute per year of age. The non-linear function provides an appropriate length time out and does not require the adult to memorize or to calculate an appropriate time out period.

The present invention occupies a child's attention and, through physical contact with the device, diverts the child's attention from unacceptable behavior during a time-out period. The timer also allows the child to see the progression of time during a disciplinary period.

Further objects, advantages, and features of the invention will be more readily understood and appreciated by reference to the detailed description of the preferred embodiments and the drawings.

MODES FOR CARRYING OUT THE INVENTION

Figure 1:
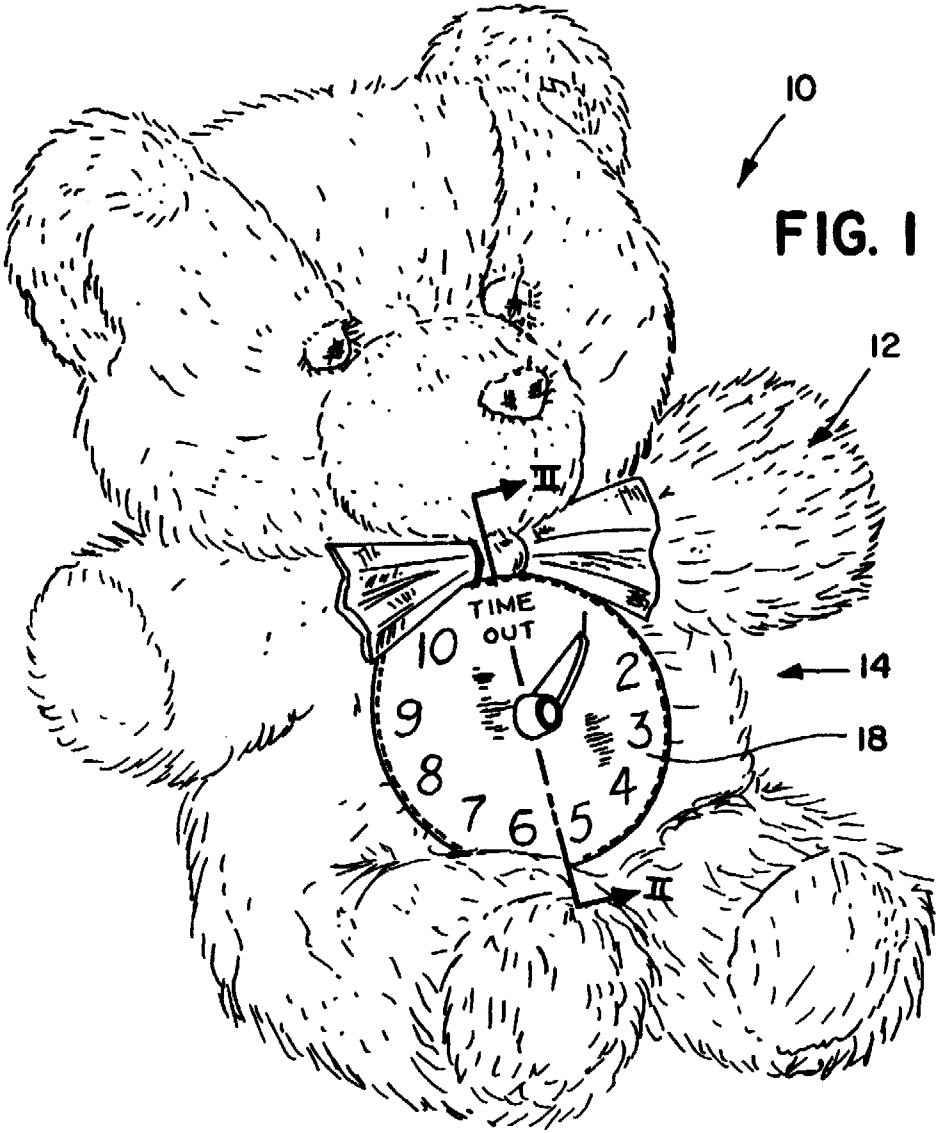
FIG. 1 is a perspective view of a first embodiment of the children's disciplinary device of the present invention.

A child's disciplinary timer constructed in accordance with a first embodiment of the invention is illustrated in FIG. 1 and generally designated 10. The disciplinary device diverts a child's attention by physically occupying the child during a period of separation from unacceptable activity.

As illustrated in FIG. 1, the device 10 includes a plush toy 12, such as a resilient teddy bear fabricated of polyester fiber material. The plush toy may be virtually any character, for example, an animal or cartoon character. The preferred embodiments described herein are all bears; however, any soft plush toy having a pleasing disposition is suitable. A countdown timer 14 including a timing device 16 (see FIG. 2) is inserted into the plush toy 12.

The countdown timer 14 is an analog timer inserted into a recess 15 in the midsection of the plush toy 12. Countdown timer refers to any timing device wherein a desired time is selected and the timer cycles backwards, or counts down to time equals zero. The timer 14 includes a face member 18 having age indications numbered 1 through 10 thereon corresponding to children's ages. Of course, greater or fewer ages may be included within the range. Alternatively, the indications on the face 18 correspond to minutes as in a conventional countdown timer.

Figure 2:
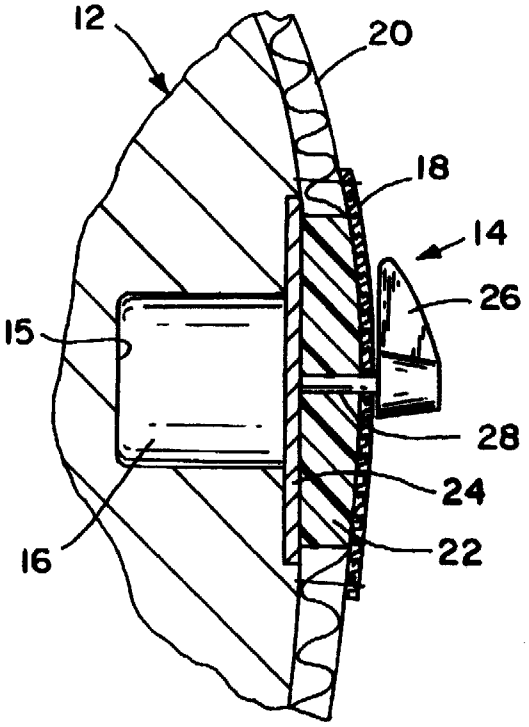
FIG. 2 is an enlarged sectional view taken along line II—II in FIG. 1.

As illustrated in FIG. 2, the face member 18 is generally co-planar with the outer surface 20 of the toy 12. The timing device 16 and the face member 18 are spatially separated by a face member support 22 and backing plate 24 mounted between the timing device and face member.

Preferably, the face member 18 is made of a flexible material, such as a flexible plastic material, that is movable and deformable with the outer surface 20 of the toy 12. The face member 18 is fastened to the surface 20 of the toy 12 to secure the timer 14 within the toy. The face member 18 is glued and/or sewn to secure the face member to the outer surface 22. Preferably, the glue is of the high density type; and the thread is a synthetic high-strength thread such as nylon or the like.

Preferably, the face member support 22 is made of a resilient material such as foam rubber. The resiliency of the face member support 22 allows the flexible face member 18 to be flexed while continuously urging the face member back to a pre-flexed contour corresponding to the outer surface 20 of the toy 12. The timing device 16 can be formed integrally with the backing plate 24 or alternatively the backing plate can be secured to the timing device. The backing plate 24 is preferably secured to the inner side of the outer surface 20 around the periphery of the backing plate. The face member support 22 is fastened by gluing or sewing to the backing plate 24 and face member 18.

The timing device 16 includes a timing hand 26 and a hand shaft 28 (FIG. 2). The hand shaft 28 connects the timing hand 26 to the timing device 16 and extends through the face member support 22 and face member 18. Preferably, the timing hand 26 and hand shaft 28 are made of a resilient material such as a synthetic rubber or like material. The timing hand 26 is set in a clockwise direction and in a preferred embodiment can only become unset under its own spring action to prevent the child from shortening the selected time-out period.

When a child is given a "time out," the parent or care-giver sets the timing device 16 and hands the toy 12 to the child. The contact between the child and the toy immediately diverts the child's attention and allows the child to observe the progression of time during the "time out" period. This diversion reduces the child's' idleness during this period, lowering the child's frustration level and interrupting unacceptable activity.

As noted above, the indications on the timer face 18 may correspond either to minutes or to ages. If the indications correspond to minutes, the parent or care-giver sets the timer to the desired number of minutes for the time-out period. In this case, the care-giver must select the time-out period for the child appropriately, requiring either calculation or memorization of the appropriate period for the age of the child.

If the indications on the face 18 correspond to ages, the clock automatically provides an appropriate time-out period as a function of, or corresponding to, the selected age. It is generally known that (1) time-out periods for young children should be less than one minute per year of age and (2) time-out periods for older children are approximately one minute per year of age. An appropriate nonlinear function between ages and time-out periods is illustrated in FIG. 6.

The nonlinear function can be implemented in a variety of fashions. First, the year designations can be spaced about the face of the clock to provide the desired time period. For example, the numbers 1 and 2 could be closer together than the remaining numbers. Alternatively, the clock can be internally configured (perhaps most easily with the digital embodiment to be described) to provide an appropriate time period depending on the selected age.

Figure 4:
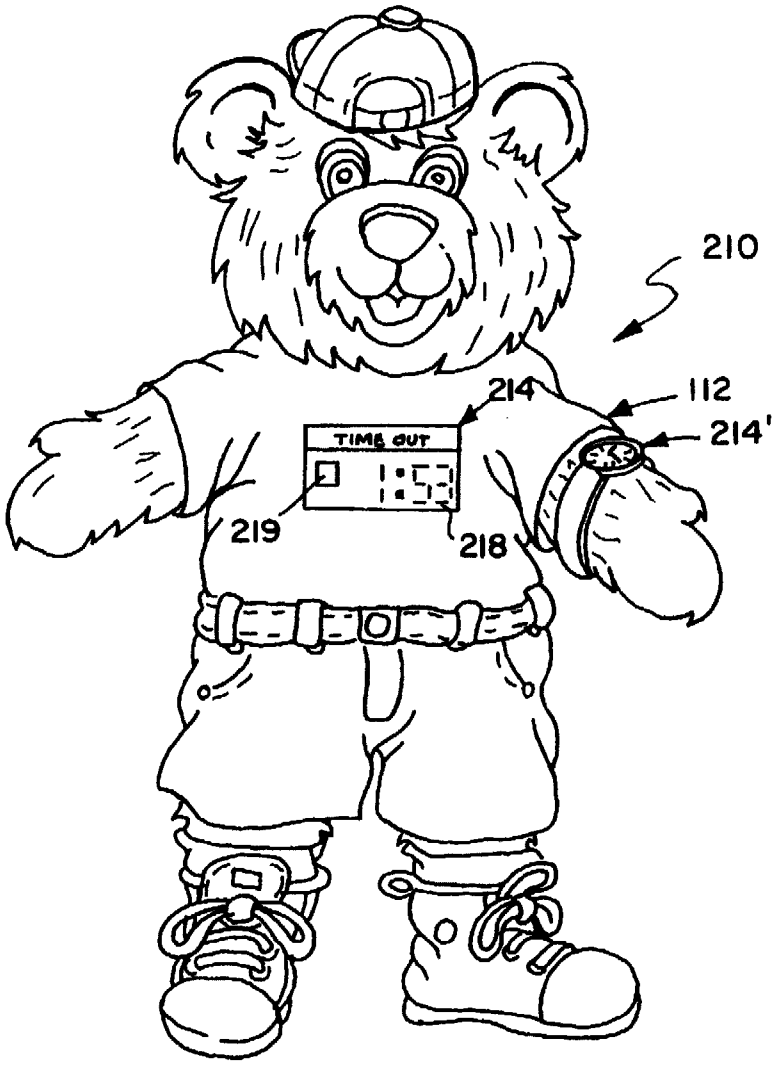
FIG. 4 is a perspective view of a third embodiment of the device.
Figure 3:
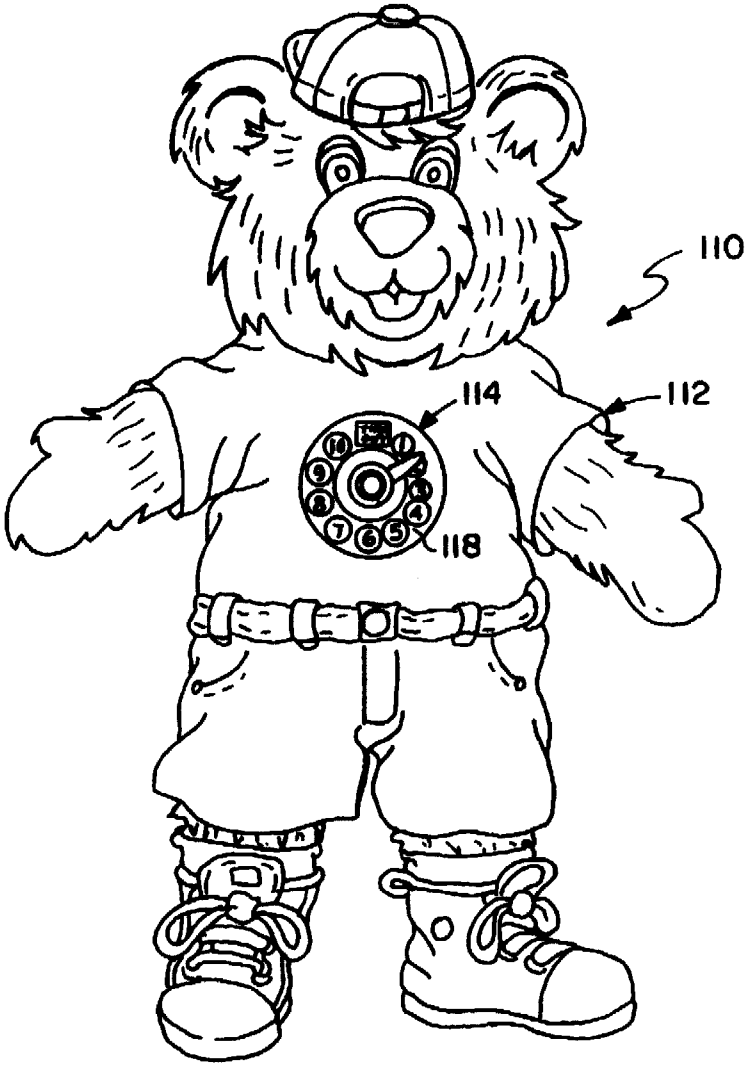
FIG. 3 is a perspective view of a second embodiment of the device.
Figures 5, 6:
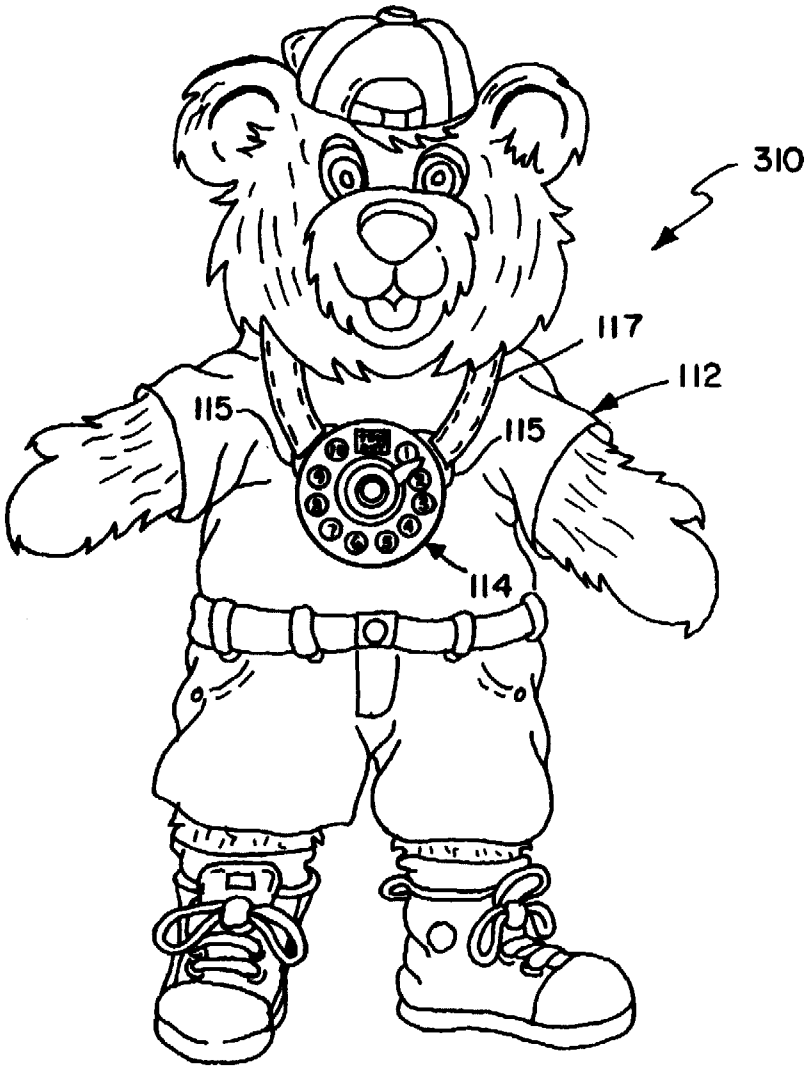
FIG. 5 is a perspective view of a fourth embodiment of the device.
FIG. 6 is a chart illustrating the nonlinear correspondence between ages and the time-out periods.

FIGS. 3–5 illustrate second, third, and fourth embodiments respectively of the disciplinary device. All three embodiments share a common stuffed character 112. By way of example only, the character is a friendly looking bear having clothes, shoes, and a backward baseball cap. It is desirable to use a plush toy appealing to a child.

The second embodiment 110 (FIG. 3) includes an analog timer 114 in the chest of the stuffed animal. As in the first embodiment, the face 118 of the timer 114 is flush with the toy 112, including any shirt or other wearing apparel on the toy. The function and use of the timer 114 is generally identical to timer 14 previously described.

The third embodiment 210 (FIG. 4) includes two timers 214 and 214'. In any one device, only one of the two timers would likely be included. Both timers are illustrated on the embodiment 210 for economies of drawings.

The timer 214 (FIG. 4) is a digital countdown timer having a face 218. The face displays 7-segment numbers in conventional fashion. A push button 219 is included in the digital timer for setting purposes. If the timer is set by minutes, the push button 219 is pressed once for each minute of desired time-out period. If the timer is age-selectable, the button 219 is pressed once for each year of the age of the child. In either case, the time-out period by minutes or age is displayed during the select operation. Subsequently, the timer converts to displaying minutes in the remaining time-out period.

The timer 214' (FIG. 4) is in the nature of a wristwatch on the characters arm, wrist, or other extremity portion. The watch may be either digital or analog. In either case, the timer functions generally identically to the previously described timers. The timer 214 is secured to the toy 210 to ensure that the child does not remove the timer from the toy during the time-out period.

The fourth embodiment 310 (FIG. 5) also includes an analog timer 114. The timer includes loops 115 by which the timer is attached to a necklace 117 extending around the neck of the stuffed animal. The necklace 117 is primarily for decoration. As with all of the embodiments, the timer 114 is securely affixed to the stuffed animal 112 so that the timer cannot be removed from about the animal's neck.

The present invention provides a comforting device for a child to hold during a time-out period. Further, the device provides the child with a readily visible indication of the time remaining in the time-out period.

The above descriptions are those of preferred embodiments of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A child's disciplinary device comprising:

a plush toy; and a countdown timer secured to said toy, said countdown timer including age indications and means for setting a time-out period associated with each of said age indications, the relationship between said age indications and said periods being nonlinear, whereby a child may be disciplined by putting the child in a time-out area, setting a desired time-out period on said countdown timer, giving said device to the child, allowing the child to hold said device, and requiring the child to stay in the time-out area until the time-out period expires.

2. A disciplinary device as defined in claim 1 wherein said plush toy comprises a stuffed character.

3. A disciplinary device as defined in claim 2 wherein said timer is secured to the chest of said character.

4. A disciplinary device as defined in claim 2 wherein said timer is secured to an extremity of said character.

5. A disciplinary device as defined in claim 2 further comprising a necklace around the neck of said character and secured to said timer.

6. A disciplinary device as defined in claim 1 wherein said timer is digital.

7. A disciplinary device as defined in claim 1 wherein said timer is analog.

8. A child's disciplinary device comprising:

a stuffed character; and a countdown timer secured to said stuffed character, said countdown timer including age indications and means for setting a time-out period associated with each of said age indications, the relationship between said age indications and said time-out periods being nonlinear.

9. A disciplinary device as defined in claim 8 wherein the relationship is:

| Age | Time-Out Period |
|---|---|
| 1 | 30 seconds |
| 2 | 45 seconds |
| 3 | 2 minutes |
| 4 | 3 minutes |
| 5 | 4 minutes |
| 6 | 5 minutes |
| 7 | 7 minutes |
| 8 | 8 minutes |
| 9 | 9 minutes |
| 10 | 10 minutes |

10. A disciplinary device as defined in claim 8 wherein said timer is analog.

11. A disciplinary device as defined in claim 8 wherein said timer is digital.

12. A disciplinary device as defined in claim 8 wherein said timer is secured to the chest of said character.

13. A disciplinary device as defined in claim 8 wherein said timer is secured to an extremity of said character.

14. A disciplinary device as defined in claim 8 further comprising a necklace around the neck of said character and secured to said timer.

* * * * *